US005577446A

United States Patent [19]

Perry et al.

[11] Patent Number: 5,577,446

[45] Date of Patent: Nov. 26, 1996

[54] STONEBLOWER HAVING ADJUSTABLE WORKHEADS AND IMPROVED BLOWING TUBES

[75] Inventors: William E. Perry, Ludington; Mark S. Krusniak, Manistee, both of Mich.

[73] Assignee: Pandrol Jackson, Inc., Ludington, Mich.

[21] Appl. No.: 388,593

[22] Filed: Feb. 14, 1995

[51] Int. Cl.[6] ..... E01B 27/02

[52] U.S. Cl. ..... 104/2; 104/11

[58] Field of Search ..... 104/7.1, 10, 11, 104/12; 406/166, 165; 37/104

[56] References Cited

U.S. PATENT DOCUMENTS

| | | | |
|---|---|---|---|
| 4,386,570 | 6/1983 | Waters | 104/11 |
| 4,449,459 | 5/1984 | Cicin-Sain | 104/12 |
| 4,497,256 | 2/1985 | Hansmann et al. | 104/12 |
| 4,528,912 | 7/1985 | Hansman et al. | 104/12 |
| 4,850,752 | 7/1989 | Carey-Yard | 104/2 |
| 5,007,350 | 4/1991 | Theurer | 104/12 |
| 5,101,733 | 4/1992 | Mohr | 104/12 |

FOREIGN PATENT DOCUMENTS

| | | | |
|---|---|---|---|
| 1065732 | 5/1954 | France | 104/12 |

*Primary Examiner*—S. Joseph Morano
*Attorney, Agent, or Firm*—Warner Norcross & Judd

[57] ABSTRACT

A stoneblower having a workhead and associated blowing tubes that adjust to skewed ties and to nonvertical tie faces. The workhead provided several degrees of movement to the blowing tubes, enabling them to be individually aligned with each tie along the length of track being worked. The blowing tubes can be pre-tilted to match the face angle of the ties. Proper location of the blow tubes is detected by monitoring the tilt change of the tube engendered when the tubes engage the ties. The blowing tubes include an elongated stone exit opening that extends both above and below the tie when the tube is inserted into the ballast. The opening therefore provides a stone discharge below the tie and an overflow above the tie. A finger extends from the lower end of the blowing tube to enable the stoneblower to sense the location of the railroad track ties without scooping ballast into the tube openings.

22 Claims, 11 Drawing Sheets

STONEBLOWER HAVING ADJUSTABLE WORKHEADS AND IMPROVED BLOWING TUBES

BACKGROUND OF THE INVENTION

The present invention relates to railroad track maintenance equipment and more particularly to a stoneblower workhead and blowing tubes.

Stoneblowers are used in the maintenance of railroad track to blow ballast stones beneath track sleepers or ties and raise the track to a desired elevation. Such stoneblowers are a wheeled car having a superstructure carrying a track lifting device, a supply of ballast stones, a source of compressed air, and a number of workheads. Each workhead carries a pair of blowing tubes. In operation, the track lifting device raises the track rails and the ties to which the rails are secured. The workhead forces the blowing tubes into the ballast adjacent the raised track ties with each pair of blowing tubes straddling a rail. Stone is then blown through the blowing tubes into the voids beneath the raised ties. The workhead withdraws the blowing tubes and the track is lowered. The stoneblower then advances to the next ties and repeats this procedure.

Blowing tubes are formed with vertically elongated end openings through which the stone exits. It is desirable to position the blowing tubes as close as possible to the ties such that the upper extents of the openings are effectively sealed against the ties, thus allowing stone to exit only beneath the tie. However, the exit opening below the tie can result in a clogged blowing tube when there is stone overflow. Some blowing tubes are provided with a second opening above the tie face to allow stone to overflow in the event the exit opening becomes clogged.

Stoneblowers have been provided with workhead mountings that allow the workheads to be moved longitudinally with respect to the superstructure and the track rails, thus allowing the blowing tubes to be positioned near the leading and trailing faces of the ties before the tubes are inserted into the ballast. Longitudinal adjustability of the stoneblower workheads is useful to allow a degree of tolerance in the placement of the superstructure over the ties and to compensate for variations in the spacing of the ties. However, longitudinal adjustability alone does not compensate for angular skewing of the ties or for ties having nonvertical leading or trailing faces. If a tie is not perpendicular to the rails, it is not possible to position both of the blowing tubes on a single workhead close against the face of the tie. If the tie has a trapezoidal cross section, as is usual with cast concrete ties, a gap exists between the upper extent of the face of the tie and the blowing tube opening.

In the past, blowing tubes have been formed from metal tubes of pipes. The stone exit openings of the blowing tubes have been formed by cutting a longitudinal slit through the tube wall and a circumferential cut at the upper end of the slit. The tube wall is then bent outwardly along either side of the slit. This creates an abrupt transition in the shape of the tube at the upper end of the exit opening. The abrupt transition creates a stress riser making the tube susceptible to cracking and damage at the transition.

SUMMARY OF THE INVENTION

The present invention provides a stoneblower having workheads which adjust to skewed ties and to nonvertical tie faces. In a first aspect of the invention, the blowing tubes are carried on workheads that are mounted such that each workhead may pivot or yaw about a generally vertical axis. Yawing of the workhead allows both tubes to be positioned against the face of a track tie even though the tie may be nonperpendicular to the track rails. According to a preferred embodiment of the invention, the vertical axis of the workhead is provided with a resilient mounting which urges the workhead toward a rest position in which the workhead is perpendicular to the rail. When the workhead is moved longitudinally toward a tie, the lower ends of the blowing tubes contact the face of the tie. If the tie is nonperpendicular, the resilient mounting allows the workhead to rotate about the vertical axis such that both blowing tubes are against the face of the tie.

In a second aspect of the invention, the workheads are mounted such that each workhead may pivot or yaw about a generally horizontal, transverse axis. In a first feature, the workhead is positive pivoted about the axis so that the blowing tubes are inclined at an angle matching the tie faces. In a second feature, the workhead is held by a hydraulic cylinder and the tubes have a negative "pre-tilt" with respect to the tie faces. As the tubes engage a tie, the work head is pivoted-extending the hydraulic cylinder to remove the "pre-tilt" and allow the control mechanism to signal that the tubes are properly positioned.

In a third aspect of the invention, a sensing finger extends downwardly from each blowing tube for sensing the location of the ties. The finger is positioned at a vertical location so as to "catch" or detect the tie as the workhead is moved forward. The finger moves easily through the ballast aided by vibration as the workhead is moved toward the next tie. Use of the finger construction prevents the tubes from "scooping up" stones as they move between ties.

In a fourth aspect of the invention, the exit openings of the blowing tubes are shaped to provide an overflow exit above the tie—even when the tubes fully penetrate the ballast. When the tube is positioned against the face of a tie, the lower portion of the opening is below the tie to discharge blown stone under the tie and the upper portion of the opening is above the tie to provide a stone overflow exit.

These and other objects, advantages, and features of the invention will be more fully understood and appreciated by reference to the written specification and appended drawings.

DESCRIPTION OF THE PREFERRED EMBODIMENT

Figure 1:
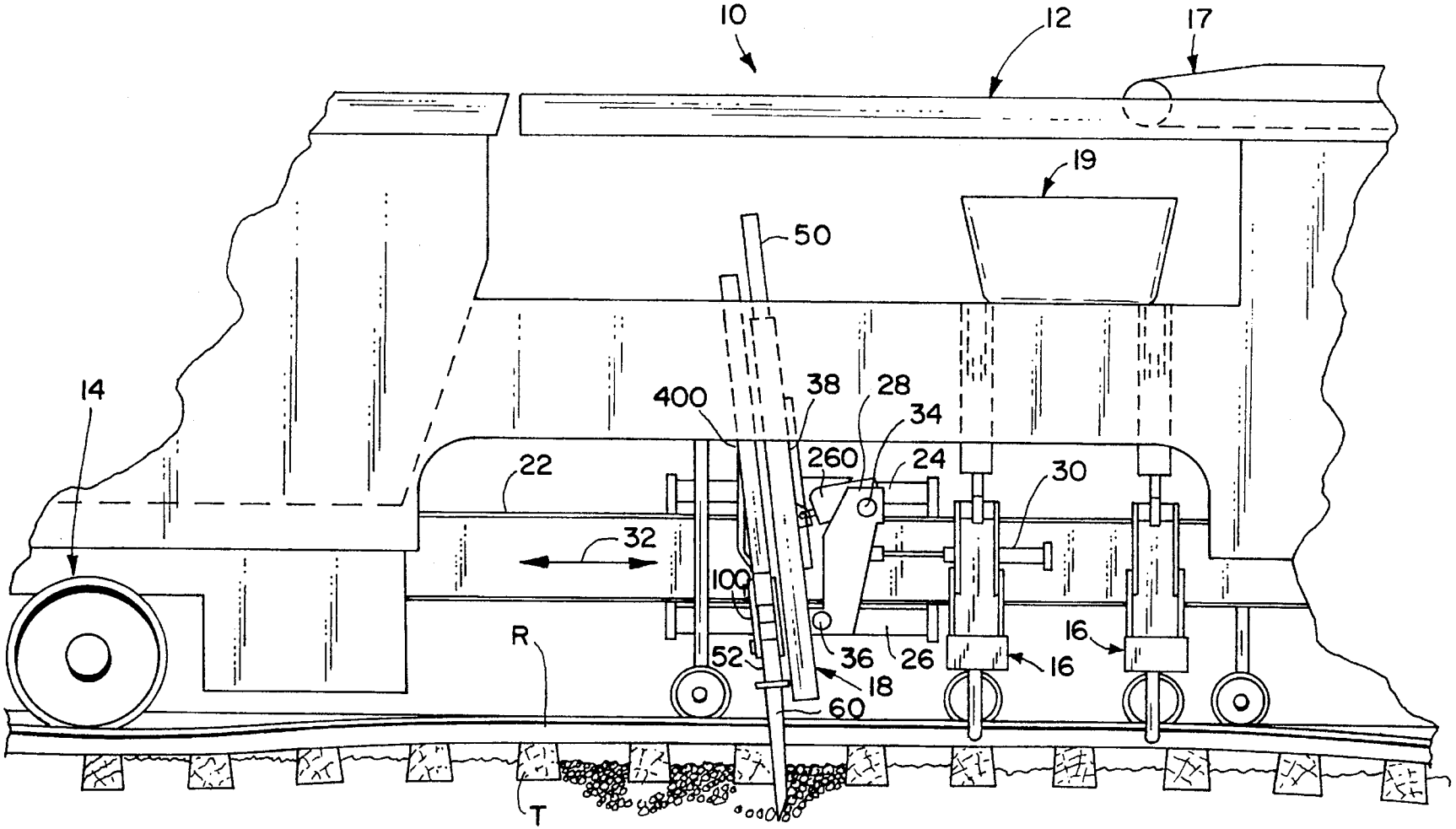
FIG. 1 is a fragmentary side elevational view of a stoneblower having a workhead and blowing tubes according to the invention.

By way of disclosing a preferred embodiment of the invention, and not by way of limitation, there is shown in FIG. 1 a portion of a stoneblower 10 which includes a superstructure 12, wheels 14 for rollingly supporting the superstructure, jacks 16 for lifting the track and attached ties, a ballast stone conveyor 17, a ballast stone hopper 19, and workheads 18 for delivering ballast under the lifted ties. Also included, but not shown, are an engine for moving the stoneblower, a supply of ballast stones, a hydraulic pump, and an air compressor.

The present invention is directed to the workhead and its operation. Generally, stoneblowers and their operation are known to those skilled in the art; and, accordingly, only a relatively brief description of the stoneblower's operation is necessary. The track is typically measured using one of two systems. First, a track measuring vehicle travels along a length of railroad track to measure the profile of the rails to determine where track maintenance is necessary. Second, the track profile may be measured by a measuring system carried by the stoneblower. Suitable measuring systems are disclosed in U.S. patent application Ser. No. 08/361,571 entitled MAINTENANCE VEHICLE AND METHOD FOR MEASURING AND MAINTAINING THE LEVEL OF A RAILROAD TRACK and U.S. patent application Ser. No. 08/311,361 entitled RAILRAOD MAINTENANCE VEHICLE REFERENCE SYSTEM TRANSDUCER, which are incorporated herein by reference. The stoneblower works the track at each location where the rails have fallen from level as indicated by the measured profile of the track. At each of these locations, jacks 16 lift the rails and the ties to which the rails are attached. The workhead then forces blowing tubes into the ballast adjacent the raised track ties. Stone is blown into the void beneath the raised ties in the appropriate quantity to level the ties. The workhead withdraws the blowing tubes, the track is lowered, and the stoneblower moves down the track to the next location.

Each workhead 18 is carried on the superstructure 12 above one of the track rails R. Although only one workhead is illustrated and visible (to reduce clutter and provide a clearer description), the stoneblower preferably includes four workheads—two associated with each of the rails—to blow stone under the two opposite ends of two ties at each indexed stop of the stoneblower. The superstructure 12 includes a pair of support beams that carry the workheads 18. The support beams 22 extend along opposite longitudinal sides of the superstructure 12. The workheads 18 are mounted to the support beams 22 by a series of carriages that allow movement of the workhead in numerous directions.

Figure 2:
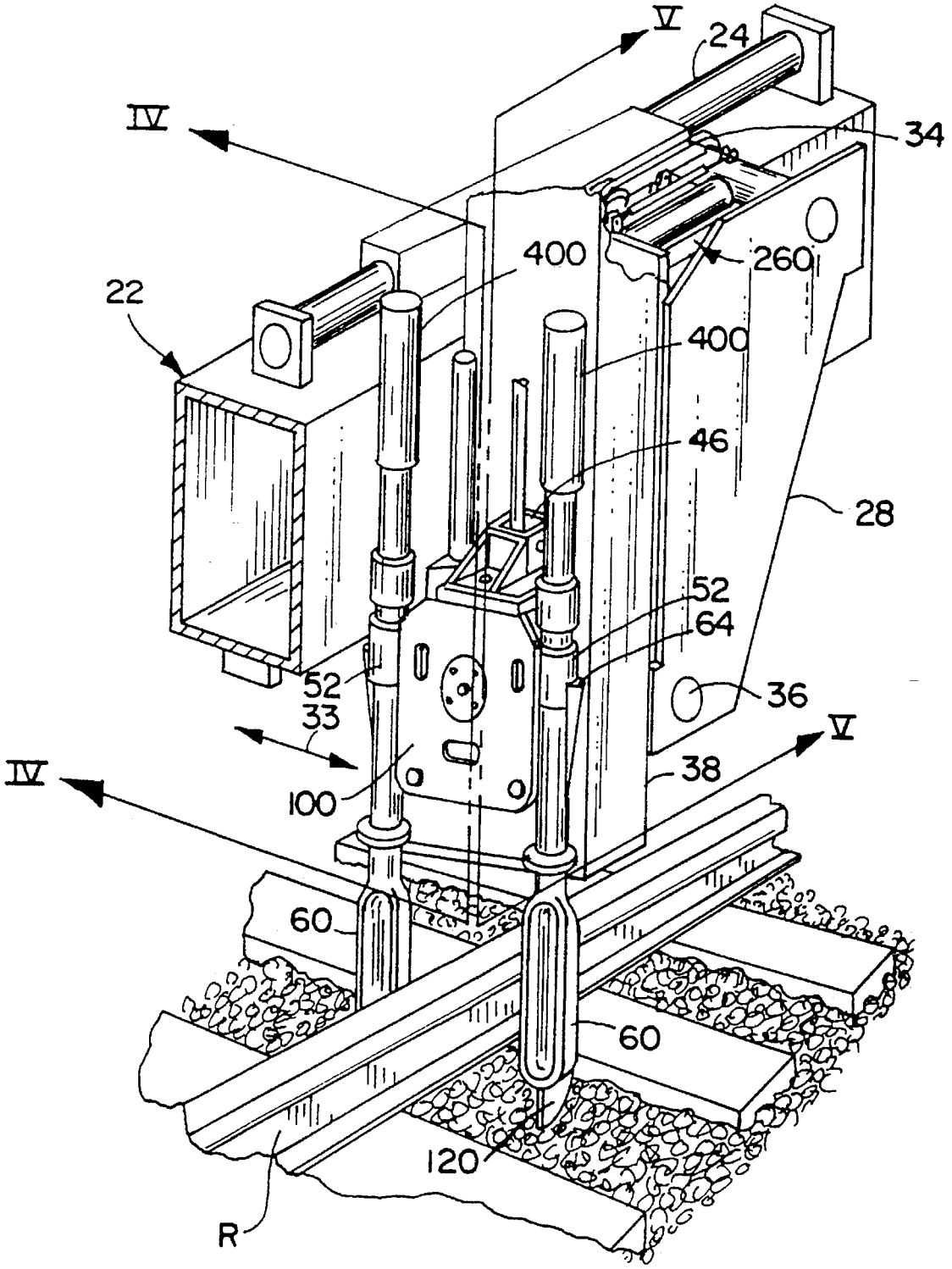
FIG. 2 is a fragmentary perspective view of a workhead.
Figure 6:
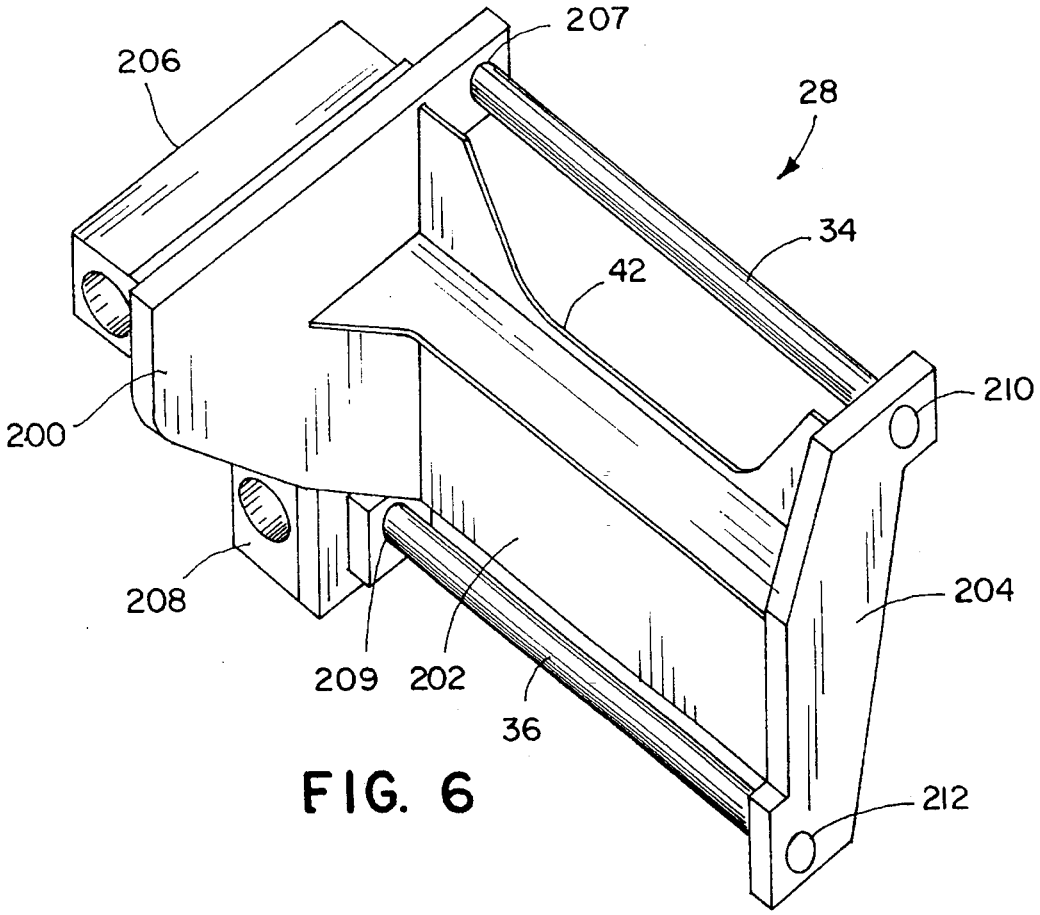
FIG. 6 is a perspective view of a longitudinal workhead carriage.

Referring now also to FIG. 2, longitudinal support beam 22 runs along the lower center of the superstructure. Upper and lower guide rods 24, 26 are affixed to the central extent of support beam 22. Each workhead has a longitudinal carriage 28 that includes an inner member 200 and a wing 42 (See FIG. 6). A pair of sleeves 206, 208 are attached to the inner surface of the inner member 200 to travel along the upper and lower guide rods 24, 26. Hydraulic cylinder 30 moves the longitudinal carriage 28 along the guide rods 24, 26 as indicated by arrow 32 of FIG. 1 to place the workhead in proper longitudinal position with respect to each tie. Upper and lower transverse guide rods 34, 36 extend outwardly from bores 207, 209 formed in longitudinal carriage 28. Wing 42 extends transversely outwardly from longitudinal carriage 28 and includes cross member 202 and outer member 204. Outer member 204 includes a pair of bores 210, 212 that support the outer ends of upper and lower transverse guide rods 34, 36.

Figure 7:
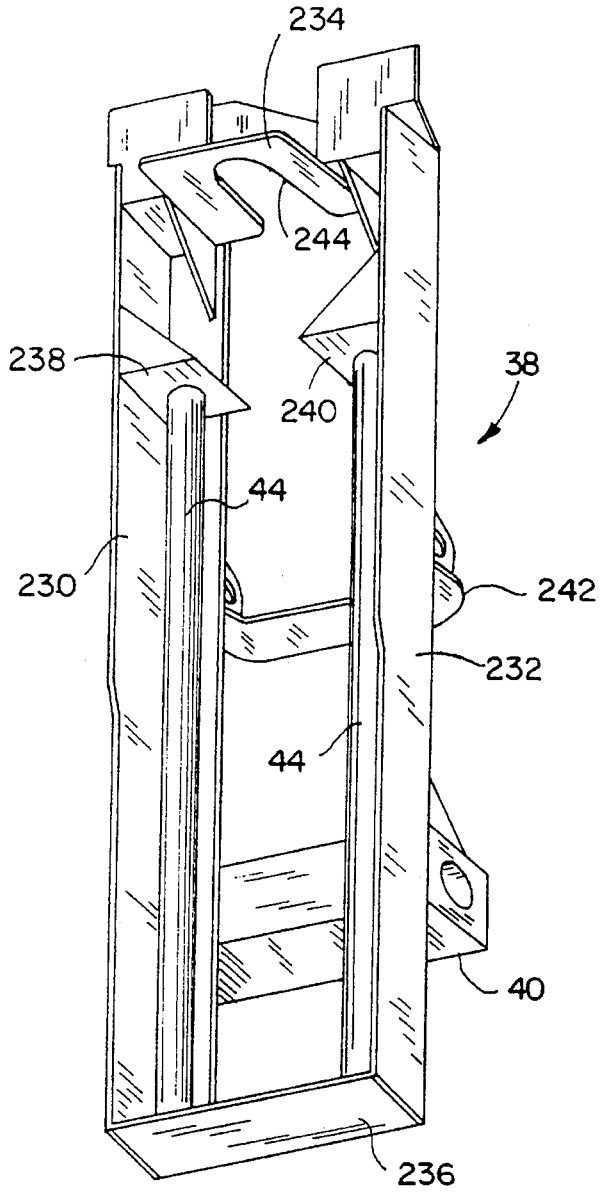
FIG. 7 is a perspective view of a transverse workhead carriage.

Workhead 18 further includes transverse carriage 38 carried by longitudinal carriage 28. Referring now to FIG. 7, transverse carriage 38 includes parallel, spaced apart side walls 230, 232 extending between upper wall 234 and lower wall 236. Upper wall 234 preferably includes a U-shaped opening 244 which, as described below, allows hydraulic cylinder 50 to engage vertical carriage 46. Guide rod brackets 238 and 240 are affixed to side walls 230, 232 to retain the upper ends of vertical guide rods 44. The lower ends of vertical guide rods 44 are attached directly to the lower wall 236. A generally U-shaped bracket 242 extends between a central portion of the side walls 230, 232 and a sleeve 40 extends between a lower portion of the side walls 230, 232.

Figure 3:
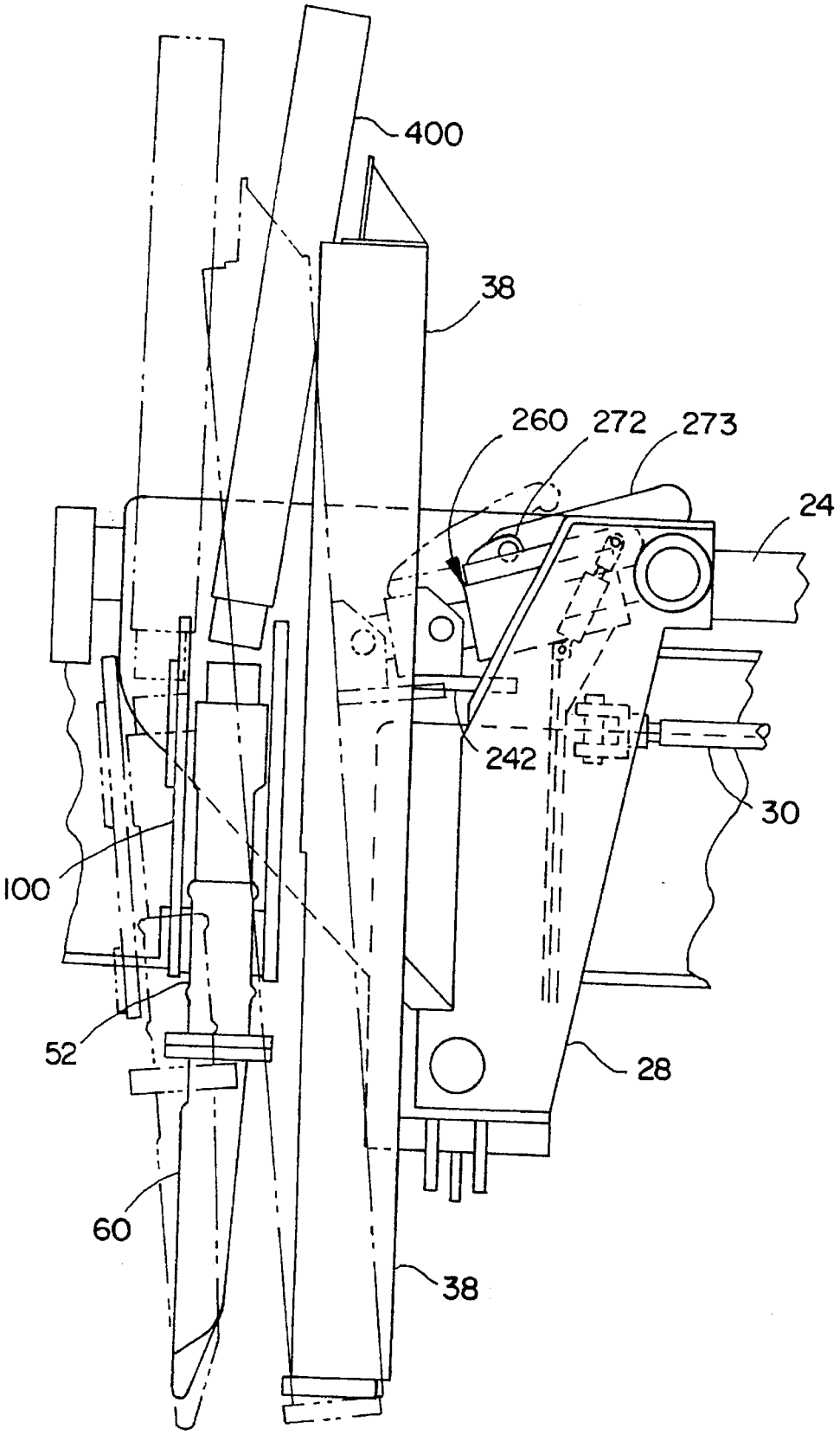
FIG. 3 is a fragmentary side view of a workhead.
Figure 8:
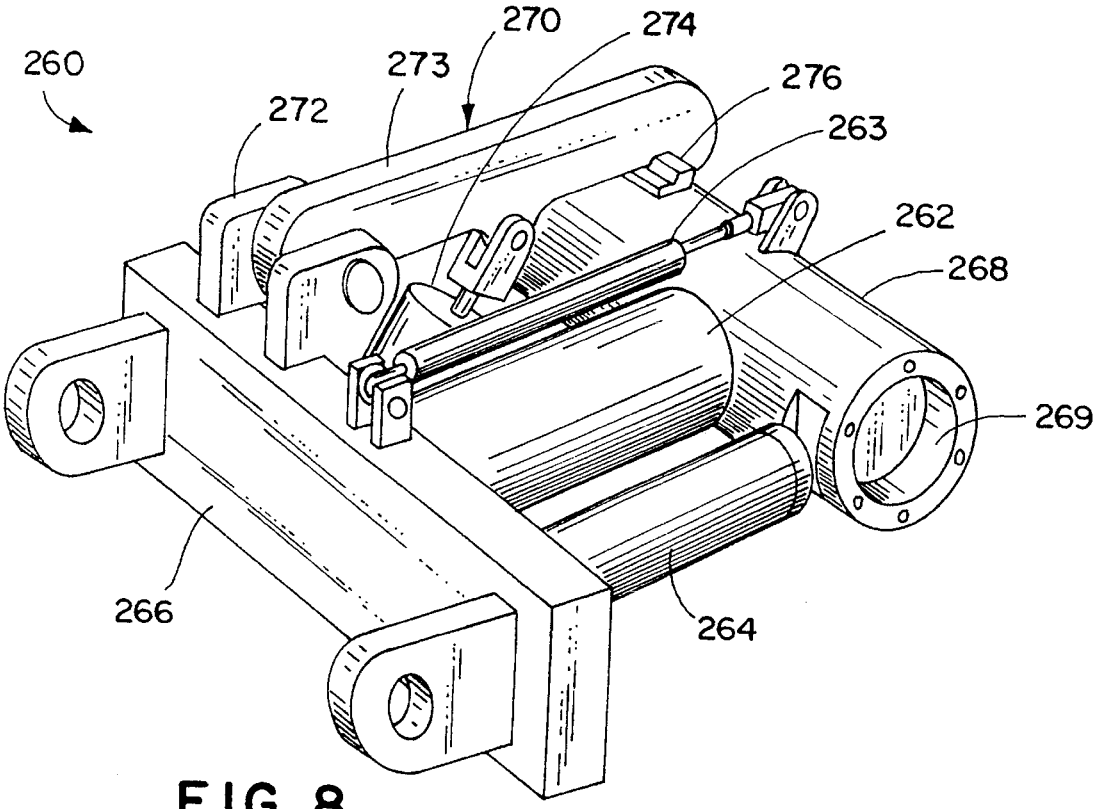
FIG. 8 is a perspective view of a workhead tilt cylinder assembly.

Transverse carriage 38 is mounted to upper transverse guide rod 34 by tilt cylinder assembly 260 and to lower transverse guide rod 36 by sleeve 40. A suitable hydraulic cylinder (not shown) interconnects transverse carriage 38 with longitudinal carriage 28 move to the transverse carriage in and out as indicated by arrow 33 of FIG. 2 to place the workhead in proper transverse position with respect to the rail R. Tilt cylinder assembly 260 is attached to the transverse carriage by bracket 266 and to upper transverse guide rod 34 by sleeve 268 which includes bushings 269. As described more fully below, tilt cylinder assembly 260 includes a tilt cylinder 262 and a position cylinder 264 to cause traverse carriage 38 to rotate or tilt about lower transverse guide rod 36 (See FIG. 8). Linear transducer 263 preferably extends between bracket 266 and sleeve 268 to provide data indicative of the tilt of the transverse carriage. In a preferred embodiment, tilt cylinder 262 is pressurized at low pressure to hold the transverse carriage 38 in either a −1° position for working on rectangular ties or in a 6° position for working on trapezoidal ties. As depicted in FIG. 3, the action of position cylinder 264 moves transverse carriage 38 between the −1° and 6° positions.

Tilt cylinder assembly 260 further includes a latch mechanism 270 to secure transverse carriage 38 in the vertical position. Latch mechanism 270 includes a hook weldment 272 attached to the upper surface of bracket 266, a hook 273 pivotally attached to hook weldment 272, a latch 276 affixed to the upper surface of sleeve 268, and a latch cylinder 274 for raising and lowering hook 273 onto latch 276.

As used herein, terms such as "vertical" and "vertically" are intended to denote the direction extending generally upward from the track bed. Such terms are not intended to be limited to a strictly vertical or plumb direction.

Figure 9:
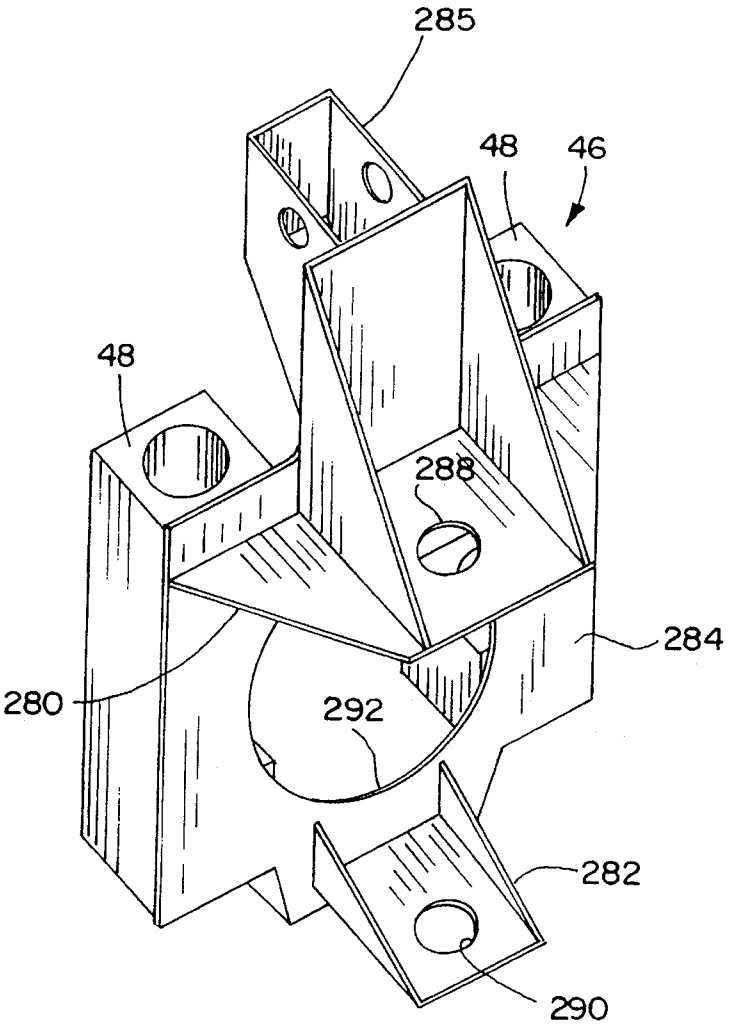
FIG. 9 is a perspective view of a vertical workhead carriage.

Vertical carriage 46 is carried by transverse carriage 38 and includes upper and lower support brackets 280, 282 extending from opposite end portions of vertical wall 284 (See FIG. 9). As perhaps best illustrated in FIG. 4, vertical carriage 46 further includes rubber spring mounting bracket 285. Bores 288 and 290 extend through brackets 280 and 282. A large circular opening 292 is formed in a central portion of vertical wall 284. As noted above, transverse carriage 38 includes vertical guide rods 44. Vertical carriage 46 is interconnect to vertical guide rods 44 by sleeves 48 which are attached to vertical wall 284. Hydraulic cylinder 50 extends between upper wall 234 and cylinder bracket 285 to interconnect vertical carriage 46 with transverse carriage 38. As a result, the action of hydraulic cylinder 50 moves vertical carriage 46 vertically with respect to the transverse carriage 38.

Figure 4:
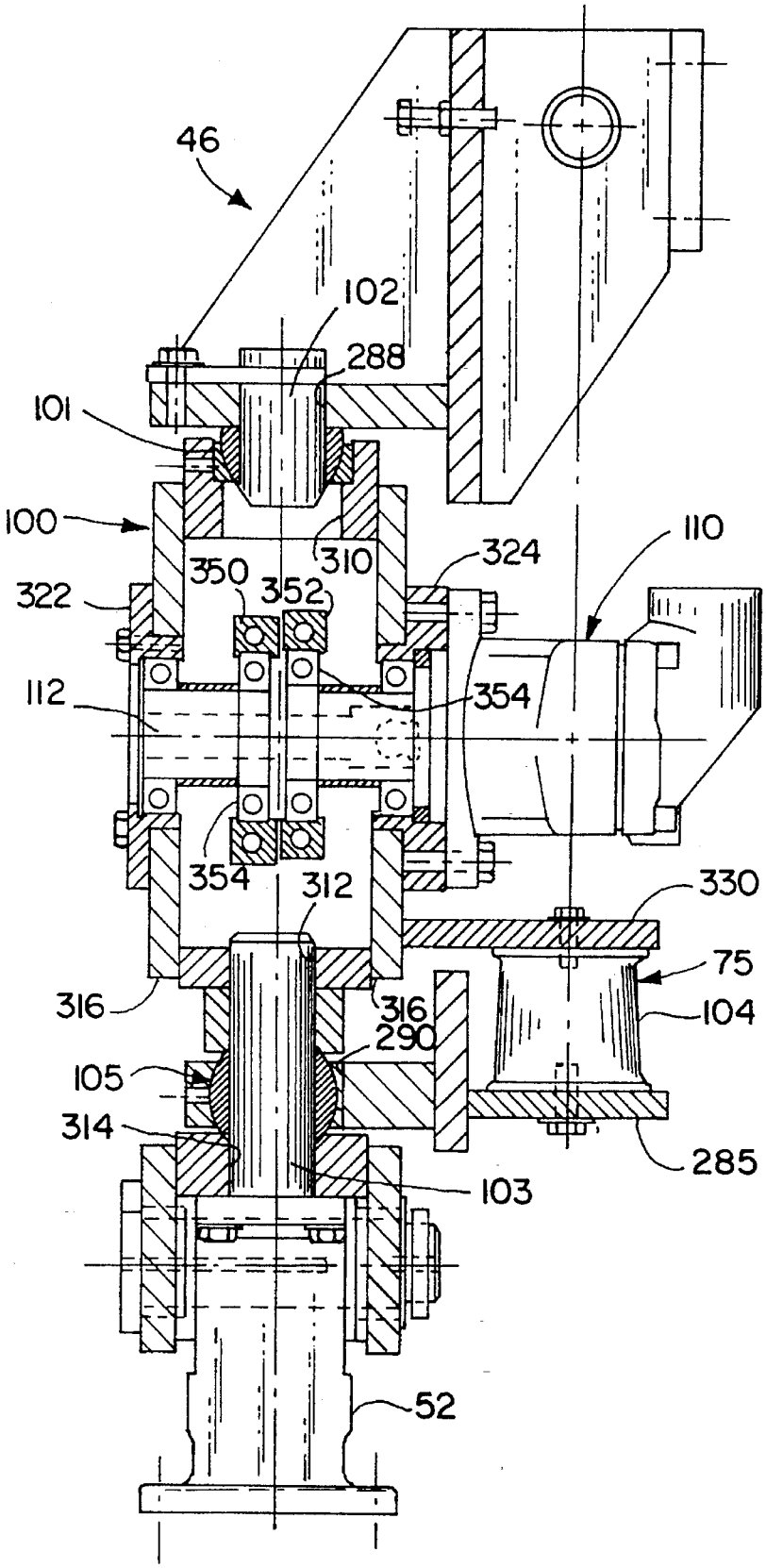
FIG. 4 is a fragmentary sectional view of a workhead taken along line IV—IV of FIG. 2.
Figure 10:
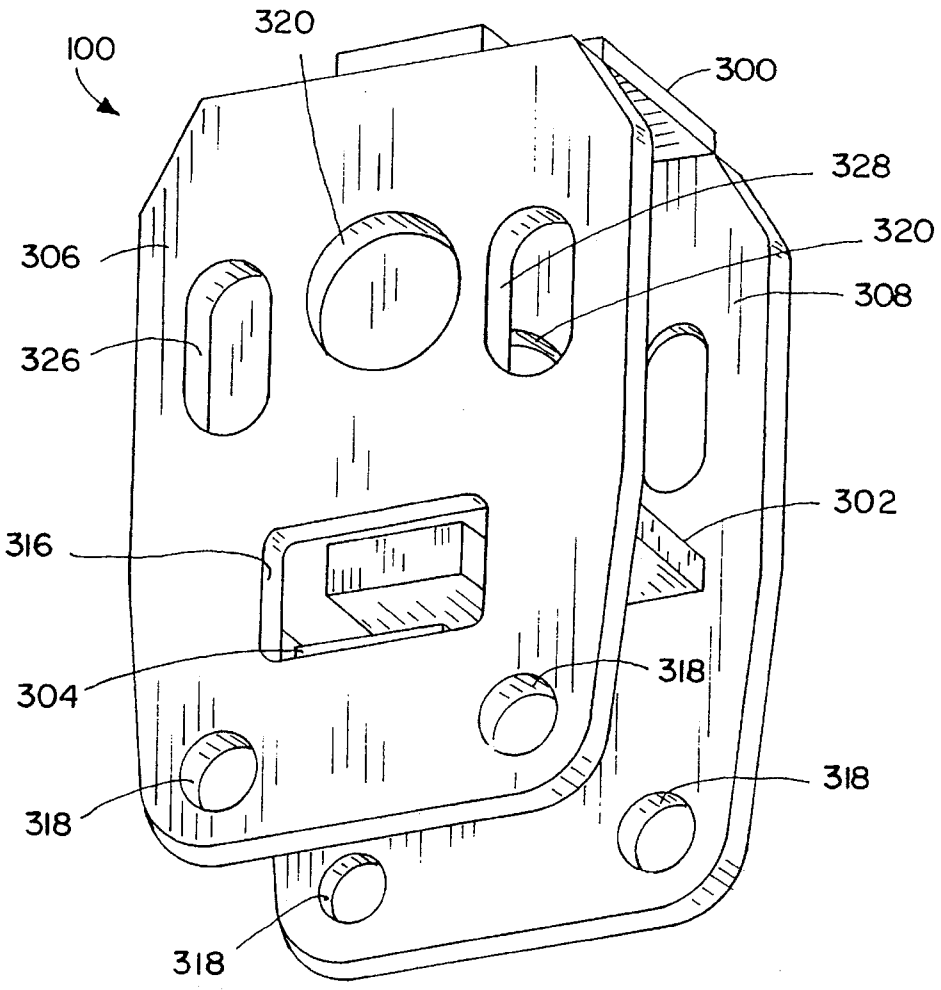
FIG. 10 is a perspective view of a workhead pivot frame.

Pivot frame 100 is mounted to the vertical carriage 46 and includes a number of cross members 300, 302, and 304 extending between front and back walls 306,308 (See FIGS. 4 and 10). A bore 310, 312, and 314 is formed vertically through a central portion of each cross member 300, 302, and 304. A rectangular opening 316 is formed through both front and back walls 306, 308 to fit around bracket 282. Also, a pair of blowing tube holder mounting bores 318 are formed horizontally through the lower corners of the front and back walls 306, 308. In addition, a pair of vertically extended slots 326,328 are formed through the front and back walls 306, 308 to allow vibratory movement of the blowing tube holders. And finally, a circular opening 320 is formed through front and back walls 306, 308 to seat bearing assemblies 322, 324.

As shown in FIG. 4, pivot frame 100 is pivotally attached to vertical carriage 46 by upper and lower pivot pins 102, 103 which extend through bores 288, 290 and bores 310, 312, and 314. Each of the two pivot pins 102,103 are preferably held in place by a washer and screw combination. Upper pin 102 and lower pin 103 are seated within a thrust bearing assembly 101 and a spherical bearing assembly 105, respectively, to allow pivot frame 100 to pivot around a generally vertical axis. The pivotal movement allows the workhead to adjust itself to skewed ties. A hydraulic vibratory motor 110 is carried by the pivot frame 100. The shaft 112 of the vibratory motor extends into the center of pivot frame 100 through bearings 322, 324 to engage blowing tubes holders 52 through a cam arrangement as described in greater detail below. A rubber sandwich mount spring 104 is installed between bracket 330 of the pivot frame 100 and bracket 285 of the vertical carriage 46 to self center the pivot frame 100.

Figure 5:
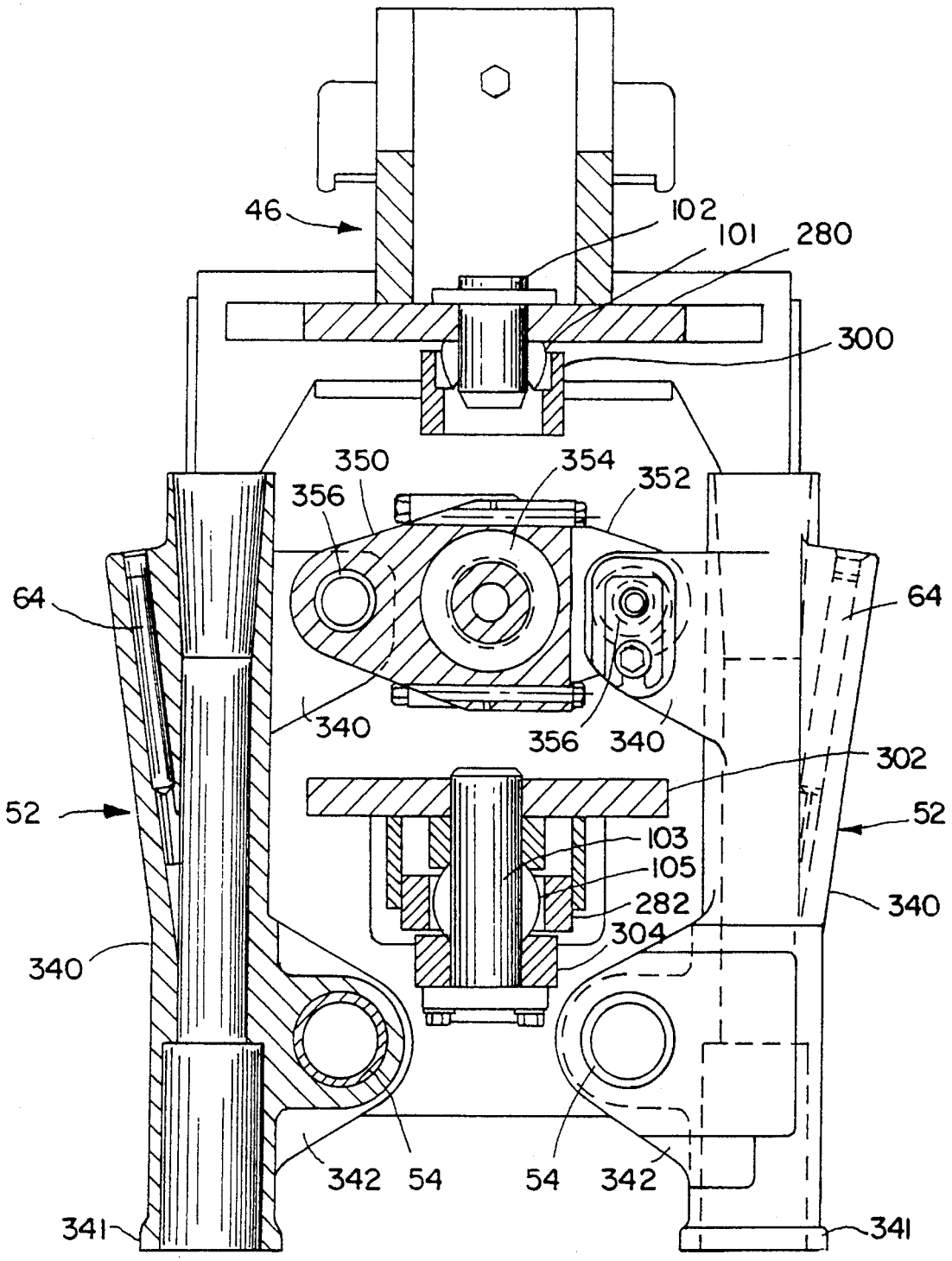
FIG. 5 is a fragmentary sectional view of a workhead taken along line V—V of FIG. 2.
Figure 11:
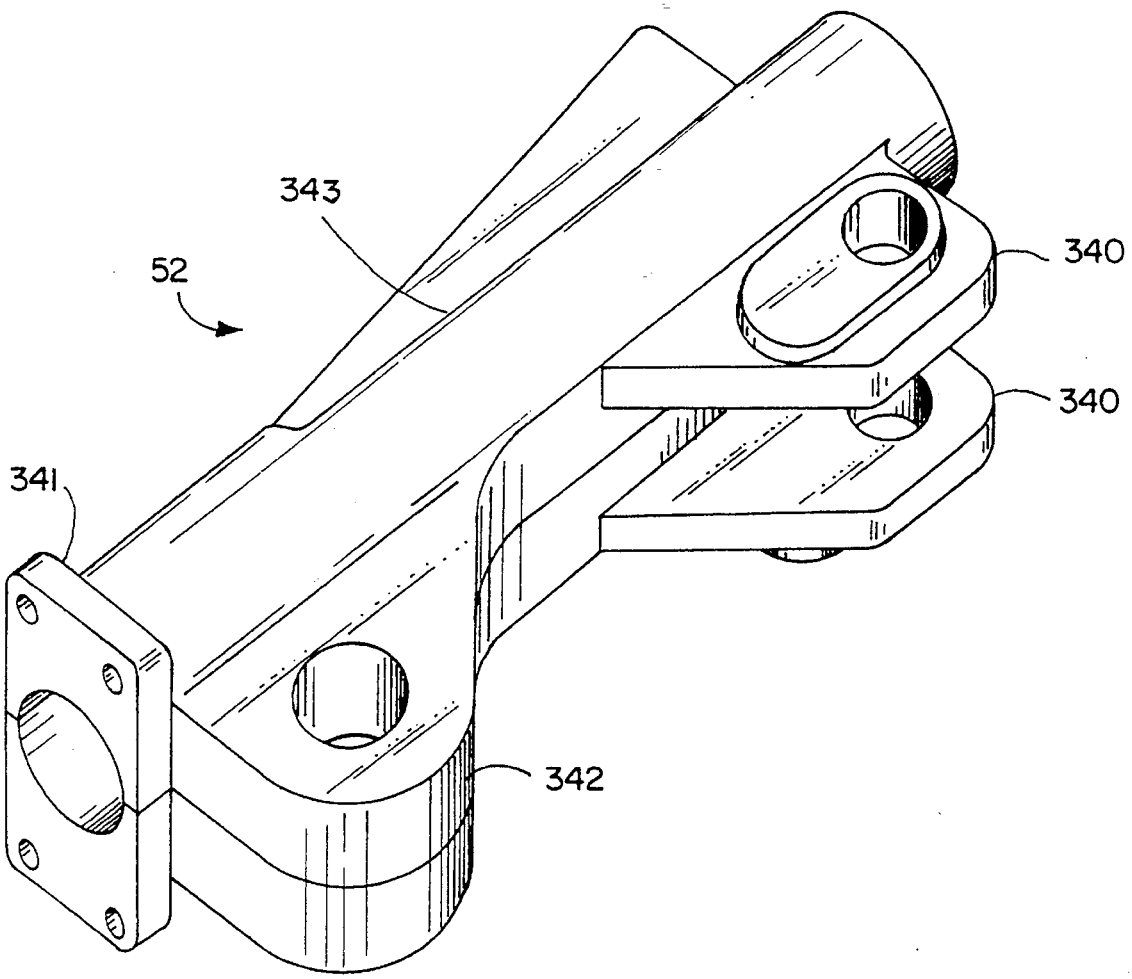
FIG. 11 is a perspective view of a blowing tube holder.

A pair of blowing tube holders 52 are mounted to pivot frame 100 (See FIG. 5). Referring now to FIGS. 5 and 11, the blowing tube holders 52 generally include upper and lower mounting ears 340, 342 extending from a vertically elongated tube 343. The lower end of the blowing tube holder includes a flange 341 adapted to mount a blowing tube 60 as described below. The lower mounting ear 342 of each blowing tube holder 52 is pivotally interconnected with pivot frame 100 at bores 318 by bushing assemblies 54. The blowing tubes 52 are further mounted to vibratory motor 110 through a cam arrangement. As perhaps best illustrated in FIGS. 4 and 5, a pair of cam links 350,352 are eccentrically mounted to shaft 112 by bearings 354 and to upper mounting ears 340 by bearings 356. The vibratory motor 110 causes the blowing tube holders 52 to oscillate rapidly about bushing assemblies 54 to aid in inserting the blowing tubes 60 into the ballast. An air inlet 64 is formed in each blowing tube holder for interconnection with a source of compressed air (See FIG. 5).

Figure 12:
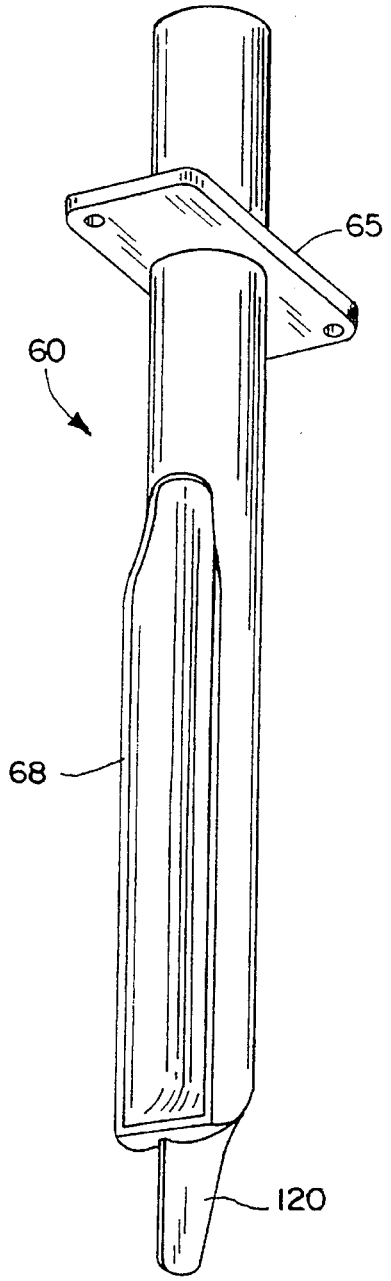
FIG. 12 is a perspective view of a blowing tube.
Figure 14:
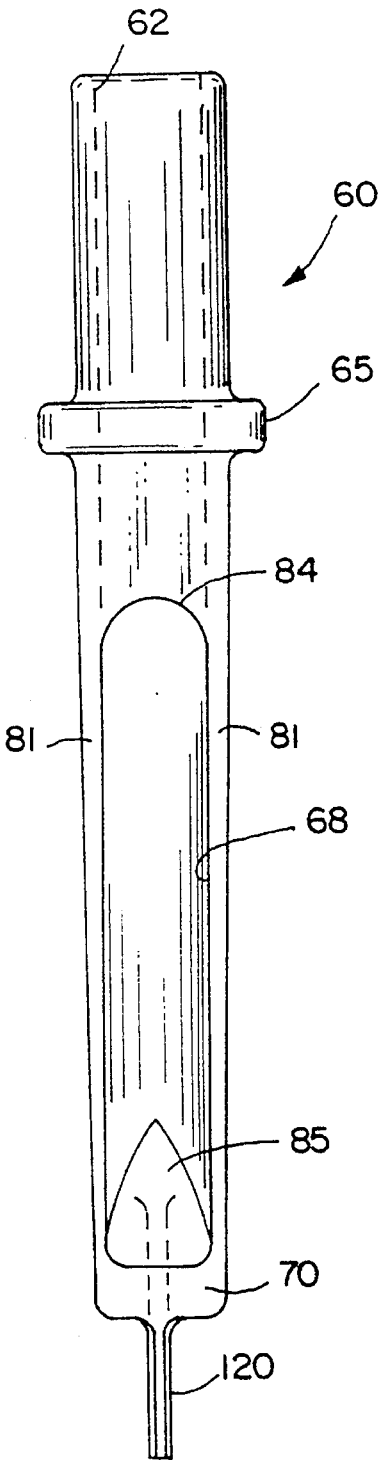
FIG. 14 is a front elevational view of a blowing tube.
Figure 15:
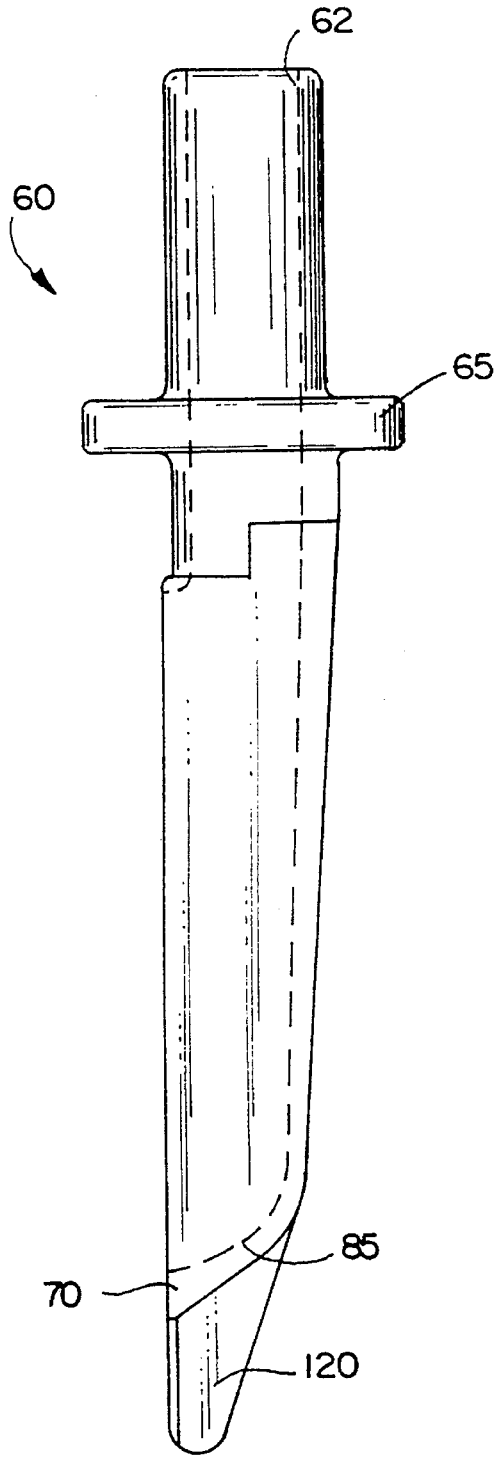
FIG. 15 is a side elevational view of a blowing tube.

As perhaps best shown in FIGS. 14 and 15, a pair of generally vertically extending blowing tubes 60 are affixed to the blowing tube holders 52. Referring also to FIG. 12, the blowing tubes are preferably formed as a cast part with an inlet opening 62 formed in the upper end and a longitudinally extended exit opening 68 formed in the lower end. The lower tip 70 of the blowing tube is pointed and wedge shaped to facilitate penetration into the track ballast and to urge the blowing tube toward the tie face as the blowing tube is moved downwardly. A flange 65 extends around the blowing tube 60 to engage flange 341. The upper portion of the blowing tube 60 is fit within the blowing tube holder 52 so that flanges 65 and 341 engage one another. The blowing tube and blowing tube holder are intersecured by conventional fasteners extending through flanges 65 and 341.

A stone metering system (not shown) conveys ballast stones to the workhead from a supply of stone held in a stone hopper. A suitable stone metering system is described in U.S. patent application Ser. No. 08/249,742 entitled STONE METERING SYSTEM FOR RAILROAD TRACK MAINTENANCE VEHICLE which is incorporated herein by reference. The stone metering system moves the stone into a suitable conduit 400 which delivers a flow of ballast stones into the inlet opening 62 of the blowing tube holders (See FIG. 2). Compressed air introduced through inlet 64 flows down through the blowing tube holder 52 into the blowing tube 60 and out the exit opening 68. The flow of air accelerates the stones downwardly through the blowing tube holders 52 and blowing tubes 60, and out exit opening 68. The blowing tubes are also formed with a finger 120 extending downwardly from the lower end of the blowing tube to sense the location of the ties.

Details of the exit opening 68 of the blowing tube 60 are shown in FIG. 14. The upper extent of the opening 68 is formed with a smooth, arcuate transition 84 interconnecting the sides 81. The lower end of the tube 60 is formed at a slant at 85. In this manner, the exit opening 68 is formed smoothly, continuously, and without abrupt discontinuities which would otherwise create stress risers. As a result, the blowing tube is better able to withstand the forces of operation without damage.

The tilting feature of the workhead mounting is illustrated in FIG. 3. When position cylinder 264 is fully retracted, carrier frame 38 is in a −1° position, as are blowing tubes 60. When position cylinder 264 is extended, carrier frame 38 rotates about lower transverse guide rod 36 such that the upper extent of the carrier frame 38 tilts forward 6°. As indicated in broken lines at 69, the upper extent of the blowing tubes tilts forward. Thus, the stoneblower may be operated with the blowing tubes oriented at −1° for use with ties having vertical leading or trailing faces, or at a 6° tilt for use with trapezoidal ties such as ties T in FIG. 1. The tilt enables the end openings of the blowing tubes to be positioned against the face of rectangular or trapezoidal ties to seal the path of the blown stones and guide the stones beneath the ties.

Figure 13:
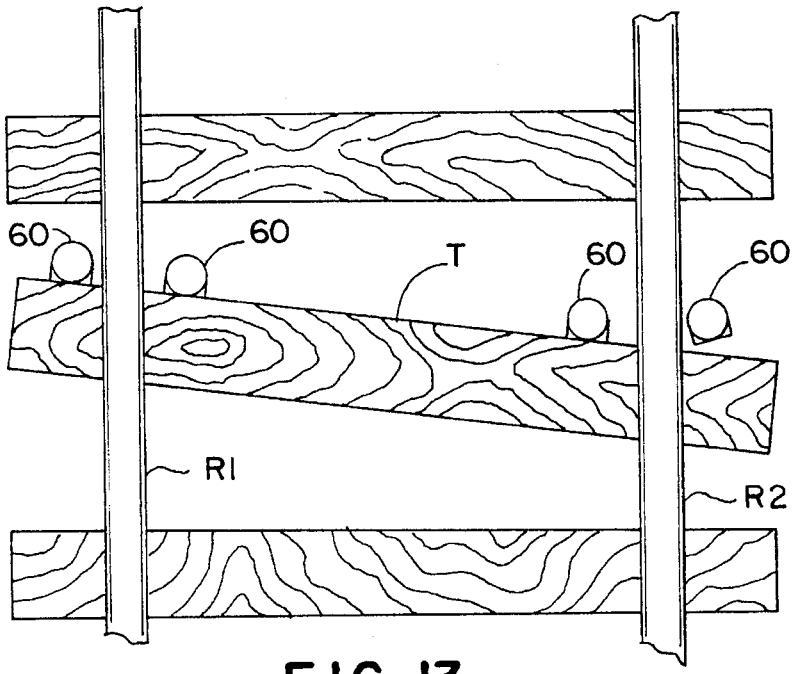
FIG. 13 is a diagrammatic top view of a section of track illustrating rotation of the workheads about vertical axes.

The yawing feature of the workhead mounting is described in connection with FIG. 13. As shown in FIG. 13, it is possible for a track tie T' to be skewed or nonperpendicular with respect to the rails. If the workhead is not able to compensate for such skewing, one of the blowing tubes, such as tube 60' will be spaced from the face of the tie leaving a gap 72 which reduces the effectiveness of the stone blowing. Yawing of the blowing head 52 is provided by the use of a rubber sandwich mount 75 to interconnect the pivot frame with the vertical carriage 46. The mount 75 preferably includes a somewhat cylindrical, synthetic rubber element 104, extending between the pivot frame 100 and the vertical carriage 46 (See FIG. 4). The pivot frame 100 pivots with respect to the vertical carriage through deformation of the rubber element 104. However, due to the resiliency of the rubber element 104, the pivot frame 100 is biased in a centered position

Operation

For simplicity and clarity, the operation of the present invention is described in connection with a stoneblower having a single workhead. It should be readily apparent that the operation may be extended to a stoneblower having virtually any number of workheads.

The stoneblower is largely automated and operates under computer control. The computer control directs operation of the stoneblower based on track profile data provided by the track measuring system. As noted above, the track profile data is collected prior to and/or during the maintenance pass of the stoneblower. The computer control processes the track profile data to determine which ties require maintenance. As the stoneblower moves along the track, the computer control stops the stoneblower at the appropriate ties to perform maintenance. If the stoneblower includes four workheads, two adjacent ties can be maintained during a single stop of the stoneblower.

Prior to operation of the stoneblower, the workhead is set at the appropriate angle to treat ties having either perpendicular faces (e.g. typically wooden ties) or angled faces (e.g. typically concrete ties). The workhead is also provided with a −1° pretilt which allows the workhead to pivot 1° upon contact with a vertically faced tie during positioning. This 1° pivot is used as a key to indicate that a tie has been located. To tilt the workhead, position cylinder 264 is either fully retracted to set the workhead at −1° for treating perpendicular tie faces, or fully extended to set the workhead at 6° for treating angled 7° tie faces. Of course, other angles could be accommodated depending on the ties to be worked.

In operation, the superstructure 12 moves along the track by indexing movement with respect to the ties. At each indexed location, the workheads and blowing tubes are spaced slightly from the face of the tie (or ties) to be worked. At this point, the blowing tubes are adjusted transversely with respect to the rail by the action of a hydraulic cylinder (not shown) that causes the transverse carriage to travel along the transverse guide rods 34, 36. Subsequently, the blowing tubes are lowered by the action of hydraulic cylinder 50 so that fingers 120 extend below the bottom of the rail, which therefore is below the upper surface of the tie. At this depth, the fingers typically extend into the ballast. Movement of the fingers 120 into the ballast is facilitated by vibratory motion of the blowing tubes resulting from operation of vibratory motor 110.

Once vertically and transversely positioned, the blowing tubes 60 are moved toward the tie face by the action of hydraulic cylinder 30 (FIG. 1). Once again, movement of the fingers 120 through the ballast is facilitated by vibratory movement of the blowing tubes 60. If the tie T is skewed, one blowing tube contacts the tie face before the other tube on the workhead as shown at the right rail R2 in FIG. 13. Further action of the hydraulic cylinder 30 causes the pivot frame 100 to yaw about a vertical axis. Longitudinal movement of the workhead continues until both tubes 60 are in contact with the tie face as shown at the left rail R1 in FIG. 13.

After both blowing tubes have engaged the tie face, continued longitudinal movement of the workhead causes the workhead to pivot or tilt. Specifically, continued forward movement causes pressure in tilt cylinder 262 to increase, eventually triggering a relief valve (not shown). Once triggered, the relief valve allows fluid to escape tilt cylinder 262 in turn allowing the workhead to tilt. A sensing device, preferably linear transducer 263, is provided to determine when the workhead has tilted a full degree, at which point movement of the longitudinal carriage is stopped.

Figure 16:
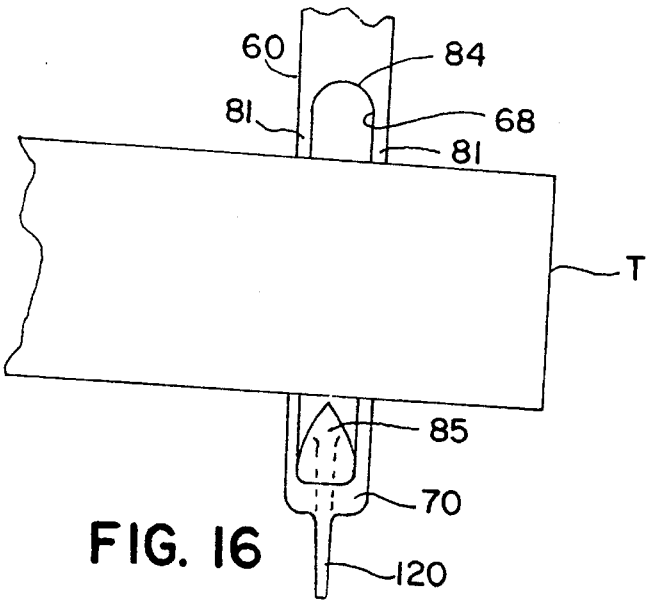
FIG. 16 is a front elevational view of a blowing tube engaging a tie face.

Next, the blowing tubes 60 are fully inserted into the ballast by further action of the hydraulic cylinder 50 so that the lower end of the exit opening 68 opens below the tie face T to allow stone to flow beneath the tie (See FIG. 16). At this depth, the upper end of the exit opening 68 opens above the tie face to provide an overflow in the event that stone backs-up in the blowing tube. At this time, the desired quantity of stone is blown beneath the tie. The computer control directs the stone metering system (not shown) to deliver the appropriate quantity of ballast stones to the workhead. The stone metering system takes stone from a stone hopper and delivers it to conduit 400. An air compressor (not shown) supplies air to air inlets 64. The air flows through the blowing tube holders and blowing tubes to propel ballast stone out exit opening 68 below the tie face. At times, stone may become clogged in the blowing tube because of improper alignment with the tie face, overfilling of the void beneath the tie, or in rare cases stone jamming itself within the tube. When clogged, stone exits from the blowing tube through the exit opening 68 above the tie face to prevent back-up of stone throughout the entire system. After the stone is blown, the blowing tubes are lifted from the ballast by the action of hydraulic cylinder 50. Once the tubes are withdrawn above the tie, the rubber sandwich mount 75 urges the pivot frame 100 back to its unyawed position. The process is repeated for each tie that has fallen from level.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A maintenance machine for railroad track, said machine comprising:

a superstructure;

a workhead supported by said superstructure;

an elongated blowing tube supported by said workhead in a generally vertical position;

pivot means for permitting said blowing tube to pivot about an axis generally perpendicular to the longitudinal direction of the track between first and second positions; and bias means for resiliently biasing said blowing tube toward said first position, whereby said blowing tube is normally in the first position and is pivoted to the second position against the bias means as said blowing tube engages a tie.

2. A stoneblower comprising:

a superstructure adapted to travel along a railroad track;

a workhead carried on said superstructure;

a blowing tube carried on said workhead;

said workhead including pivot means for permitting said blowing tube to pivot along a horizontal axis generally transverse to the longitudinal direction of the railroad track, whereby said blowing tube is tilted about said horizontal axis between a first tilt angle and a second tilt angle as said blowing tube engages a tie in the track.

3. The stoneblower of claim 2 comprising two of said blowing tubes carried by said workhead, said workhead having a yaw angle and a means for permitting said workhead to pivot about a generally vertical axis to vary said yaw angle, whereby said workhead can pivot so that said blowing tubes can both engage even a skewed tie in the track.

4. The stoneblower of claim 2 further comprising a finger means extending from the bottom of said blowing tube for sensing the location of a tie of the track.

5. The stoneblower of claim 4, wherein said blowing tube includes a lower end, and wherein said finger means includes a blade extending from said lower end of said blowing tube.

6. The stoneblower of claim 2, wherein said blowing tube defines an opening, said opening extending along said blowing tube a distance greater than the height of a tie, whereby, when said blowing tube is positioned against the tie with said opening facing said tie, said opening extends both above and below the tie.

7. A stoneblower comprising:.

a superstructure adapted to travel along a railroad track;

a workhead carried on said superstructure;

at least two blowing tubes carried on said workhead, said workhead having a yaw angle and a means for permitting said workhead to pivot about a generally vertical axis to vary said yaw angle, whereby said workhead can pivot so that said blowing tubes can both engage even a skewed tie in the track, said workhead including a pivot frame pivotally secured to a vertical carriage, said workhead further including a resilient means for biasing said pivot frame in a first yaw angle;

said workhead including pivot means for permitting said blowing tubes to pivot along an axis generally transverse to the longitudinal direction of the railroad track, whereby said blowing tubes may be tilted between a first tilt angle and a second tilt angle as said blowing tubes engages a tie in the track.

8. A method of stoneblowing additional ballast under the ties of a railroad track, said method comprising the steps of:

providing a stoneblower workhead having a blowing tube pivotable about a horizontal axis generally perpendicular to the longitudinal direction of the track;

biasing the blowing tube about said axis toward a first position;

moving the stoneblower workhead longitudinally along the track until the blowing tube engages a tie and pivots away from the first position against the bias;

detecting such pivoting of the blowing tube; and stopping the stoneblower workhead in response to said detecting and working the track at the tie.

9. A stoneblower for working a track having ties and rails, said stoneblower comprising:

a superstructure;

a workhead supported by said superstructure, said workhead including a tube support and pivot means for permitting said tube support to pivot with respect to the remainder of said workhead about a generally vertical axis, said workhead further including bias means for biasing said tube support to a home position;

a pair of blowing tubes mounted at spaced locations on said tube support in a direction generally transverse to the longitudinal direction of the rails.

10. A stoneblower comprising:

a superstructure adapted to travel along a railroad track;

a workhead carried on said superstructure;

a pair of blowing tubes carried on said workhead, said blowing tubes being spaced from one another in a direction generally perpendicular to the longitudinal direction of the track, said blowing tubes having a yaw angle;

pivot means for permitting said tubes to pivot in tandem about a generally vertical axis to vary said yaw angle, whereby said blowing tubes may pivot in tandem about a skewed tie in the track; and a resilient means for biasing said blowing tubes toward a first yaw angle.

11. The stoneblower of claim 10, wherein said workhead includes a pivot frame pivotally secured to a vertical carriage, said resilient means biasing said pivot frame toward said first yaw angle.

12. The stoneblower of claim 10, wherein said workhead includes a finger means for sensing the location of a railroad tie of the railroad track.

13. The stoneblower of claim 12, wherein said blowing tube includes upper and lower ends, and wherein said finger means includes a blade extending from said lower end of said blowing tube.

14. The stoneblower of claim 10, wherein said blowing tube includes an exit opening formed in said lower end, said exit opening being dimensioned to exceed the height of a railroad tie of the railroad track whereby said blowing tube may be positioned against the tie with a portion of said exiting opening lying above the tie and a portion of said exiting opening lying below the tie.

15. A method of stoneblowing railroad track comprising:

providing a pair of spaced blowing tubes mounted on a common support structure for pivotal movement about a generally vertical axis;

biasing the support structure to a home position;

moving the blowing tubes toward a tie in the track until the tubes engage the tie, the support structure pivoting as necessary from the home position under the force of the tubes engaging the tie.

16. A railroad track stoneblower comprising:

a superstructure adapted to travel on a railroad track;

a workhead supported by said superstructure;

a blowing tube supported by said workhead for vertical reciprocable movement with respect to the track;

pivot means for permitting said blowing tube to pivot about a generally horizontal axis generally perpendicular to the longitudinal direction of the track between first and second positions corresponding to first and second angles; and motive means for positively shifting said blowing tube about said pivot means between said first and second positions, whereby said blowing tubes can be oriented to be generally parallel to tie faces inclined at the first and second angles.

17. A workhead for a railroad track maintenance vehicle, comprising:

a first carriage adapted to mount to the track maintenance vehicle;

a second carriage pivotally secured to said first carriage;

at least one blowing tube carried by said second carriage;

said second carriage having a horizontal axis of rotation extending substantially transversely to a longitudinal extent of the railroad track whereby said blowing tube is tilted about said horizontal axis between a first tilt angle and a second tilt angle to adapt to different angled tie surfaces.

18. The workhead of claim 17 further comprising a tilt means for selectively moving said second carriage between said first and second tilt angles with respect to said first carriage.

19. A workhead for a railroad track maintenance vehicle, comprising:

a first carriage adapted to mount to the track maintenance vehicle;

a second carriage pivotally secured to said first carriage;

at least one blowing tube carried by said second carriage;

said second carriage having a transverse axis of rotation whereby said blowing tube may be tilted between a first tilt angle and a second tilt angle;

a tilt means for selectively moving said second carriage between said first and second tilt angles with respect to said first carriage; and a third carriage pivotally secured to said second carriage, said third carriage having a vertical axis of rotation whereby said blowing tube may be yawed between a first yaw angle and a second yaw angle.

20. The workhead of claim 19 further comprising a resilient means for biasing said third carriage in said first yaw angle.

21. A method of stoneblowing railroad track comprising the steps of:

providing a blowing tube mounted on a support structure for pivotal movement about a generally horizontal axis extending generally transverse to the longitudinal direction of the railroad track;

orienting the blowing tube with a pre-tilt;

moving the blowing tube toward a tie in the track until the tube engages the face of the tie and pivots a predetermined distance from the pre-tilt under the force of the tube engaging the tie; and blowing ballast stone under the tie.

22. The method of claim 21 wherein said blowing tube includes a downwardly extending finger; and further comprising the steps of:

positioning the support structure such that only the finger of the blowing tube extends into a ballast around the tie, whereby the finger engages the face of the tie when the blowing tube is moved during said moving step; and after the tube pivots the predetermined distance and before said blowing step, inserting the blowing tube into the ballast a sufficient distance to accommodate stoneblowing.

* * * * *